US005178331A

United States Patent [19]

Schuerz

[11] Patent Number: 5,178,331

[45] Date of Patent: Jan. 12, 1993

[54] DEVICE FOR ATOMIZATION OF FLUIDS

[75] Inventor: Willibald Schuerz, St. Peter, Australia

[73] Assignee: Robert Bosch GmbH, Stuttgart, Fed. Rep. of Germany

[21] Appl. No.: 656,094

[22] PCT Filed: May 30, 1990

[86] PCT No.: PCT/DE90/00402

§ 371 Date: Feb. 27, 1991

§ 102(e) Date: Feb. 27, 1991

[87] PCT Pub. No.: WO91/00426

PCT Pub. Date: Jan. 10, 1991

[30] Foreign Application Priority Data

Jun. 28, 1989 [DE] Fed. Rep. of Germany ..... 3921079

[51] Int. Cl.[5] ..... B05B 1/34; B05B 7/06

[52] U.S. Cl. ..... 239/405; 239/466

[58] Field of Search ..... 239/402, 403, 405, 468, 239/466, 462

[56] References Cited

U.S. PATENT DOCUMENTS 1,451,063 4/1923 Anthony ..... 239/405

3,771,728 11/1973 Polnauer ..... 239/468

3,811,278 5/1974 Taylor et al. ..... 239/402

3,853,273 12/1974 Bahr et al. ..... 239/402

4,218,012 8/1980 Hamza et al. ..... 239/405

FOREIGN PATENT DOCUMENTS 1366581 9/1974 United Kingdom ..... 239/468

2198521 12/1986 United Kingdom ..... 239/405

*Primary Examiner*—Andres Kashnikow

*Assistant Examiner*—Kevin P. Weldon

*Attorney, Agent, or Firm*—Edwin E. Greigg; Ronald E. Greigg

[57] ABSTRACT

A known device for the atomization of liquids for injection valves including upper and lower fluid entry levels by which a tangential entry of air is provided into a space located below the injection valve in the direction of flow by which the generally occurring unevenness of distribution of fuel to different cylinders of an internal combustion engine is to be improved. The entry of the fluid from the upper and lower levels are oppositely oriented at the individual levels and thus produce two opposing swirl flows. The device is particularly suitable for injection valves for internal combustion engines.

5 Claims, 3 Drawing Sheets

DEVICE FOR ATOMIZATION OF FLUIDS

STATE OF THE ART

The invention is directed to a device for the atomization of liquids such as for internal engines. The invention is therefore in the sphere of the atomization of liquids by means of compressed air produced independently or by a use of the suction in the manifold of internal combustion engines. The liquids used are particularly fuels to be mixed for combustible mixtures for internal combustion engines with external mixture production. Compressed air or suction in the manifold have up to now been used to atomize fuels in such a manner that the air expanded at an annular slot seizes at high velocity the fuel jet emanating from the opening of the injection valve. The great difference in velocity between the air and fuel leads to atomization.

This type of atomization is however disadvantageous in that fine droplets resulting from the atomization process are accelerated to high velocities in the air flow so that they are in part no longer able to follow a change of direction of the flow of the intake air. The droplets impinge against the wall of the manifold and contribute to the formation of a film on the wall. Only very small tolerances are permissible fir the excentricity of entry of the fuel into the air flow. Excessive manufacturing tolerances in this area lead to deviation sideways of the atomized fuel jet in consequence of which there results in the case of centralized injection an increase in the unevenness of fuel distribution between the individual cylinders of a multi-cylinder engine. A fuel injection device for internal combustion engines is also already known in which the opening of an injection valve is directed into an auxiliary air nozzle whereby the fuel and the air are mixed by swirling in a swirl chamber formed therein. The air entry into the interior space of the auxiliary air nozzle is in this case tangential.

ADVANTAGES OF THE INVENTION

The device for atomization of liquids has an advantage that due to the low exit velocity from the device of the droplets of liquid, these are able to follow the changes of direction of the intake air. The unevenness of distribution of fuel between the individual cylinders of a multi-cylinder internal combustion engine can thereby for instance in the case of centralized injection be effectively reduced particularly in the full power range. The quantity of liquid forming a film on the wall is also reduced, which has a positive effect on the smooth running of internal combustion engines. The atomized jet of liquid emanating from the device has a very good jet symmetry so that there is no unevenness of distribution. In particular no deviation sideways of the liquid jet. This is of particular importance in internal combustion engines.

Advantageous further developments and improvements of the device specified are made possible by measures described hereinafter.

The above advantages are set forth by the use of slits at different levels one above the other in which each open into an annular channel and the annular channels taper with reducing radius and open into a cylindrical opening. In addition it is advantageous if there are several, particularly two, slits in each annular channel. The geometry of the jet of atomized liquid and, in the case of the use of fuel, the distribution of the concentration of the fuel droplets, can be influenced by selecting the number of the tangentially entering slits per swirl level and the geometric position of the slits if the upper or lower swirl level relative to each other. Thereby a further means is obtained to reduce the unevenness of fuel distribution between the individual cylinders by the atomization of the fuel.

Drawing

The invention is shown in the drawing in the form of an example.

DESCRIPTION OF AN EMBODIMENT

The device will be explained with regard to a centralized injection unit, but its application is not limited to such a centralized injection unit. Nor is the invention limited to the atomization of fuel, but any liquid which must be atomized can be used with the present invention.

Figure 1:
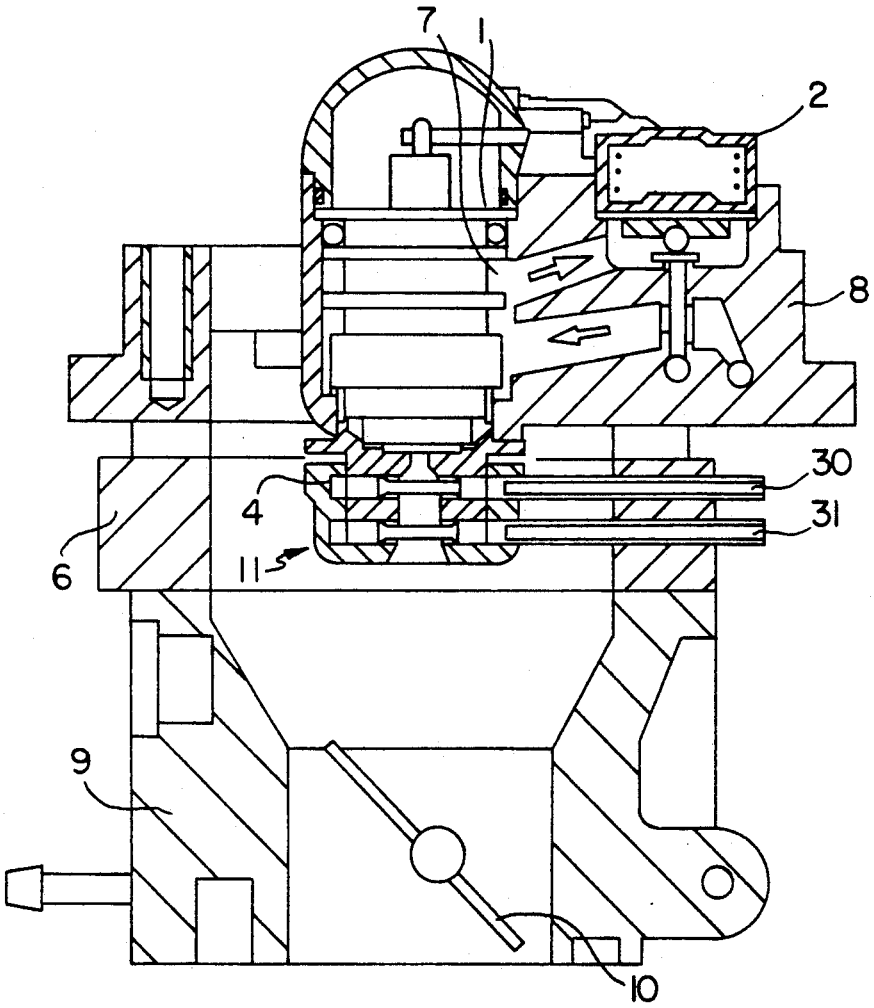
FIG. 1 shows a sectional representation of a centralized injection unit in accordance with the invention as related to a fuel injection valve.

The centralized fuel injection device 11 in accordance with FIG. 1 is shown in combination with an injection valve 1 and is fitted directly on the manifold and supplies finely dispersed fuel to the motor. In addition to the injection valve 1, a pressure regulator 2 connected to the injection valve through a duct 7 and a throttle valve housing 9 with a throttle valve 10 is shown.

Figure 2:
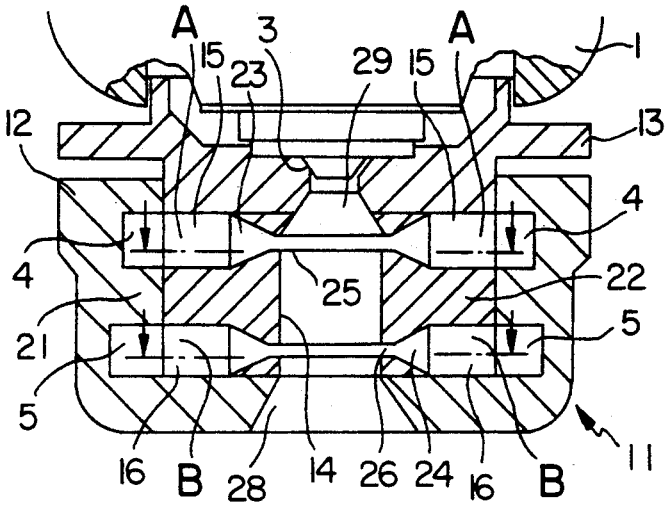
FIG. 2 is a detail of the atomization device shown in of FIG. 1 in accordance with the invention.

An intermediate ring 6 is provided between the throttle valve housing 9 and upper housing 8 which positions the injection valve in place. The intermediate ring 6 encompasses the atomizing device 11 in accordance with the invention to which there lead two air ducts 30, 31. This device 11 in accordance with the invention is shown in more detail in FIG. 2.

Figure 3:
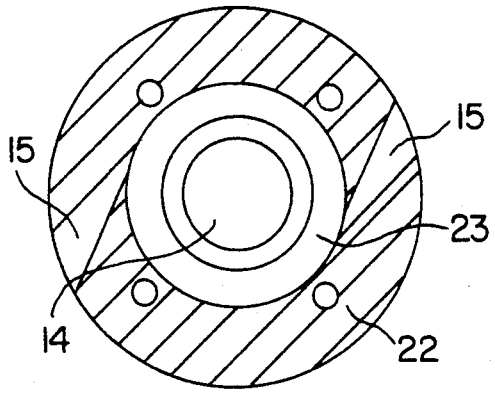
FIG. 3 is a section along the line A—A of FIG. 2.
Figure 4:
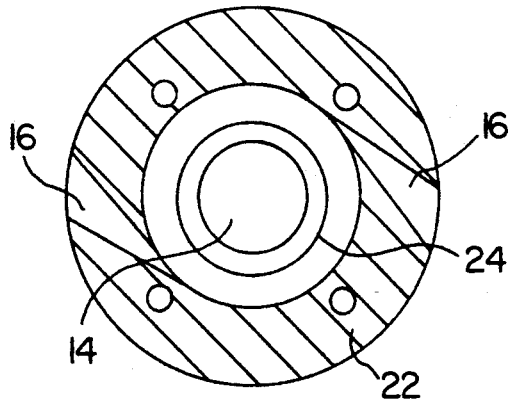
FIG. 4 is a section along line B—B of FIG. 2.

The injection valve has a valve seat in a known manner on which the valve 1 is opened and closed. Underneath the valve opening 3, that is to say below the valve seat, a housing 12 with an annular disk 13 is arranged upon which is sealed the injection valve 1, whereby the housing 12 has at different levels annular air inlets 4, 5 which are separated from each other by a ridge 21. These air inlets 4, 5 receive compressed air from ducts 30,31. A dividing ring 22 aligned radially with the ridge 21 is set in the housing 12 between the annular disc 13 and the bottom of the housing 12. The dividing ring 22 has been elaborated with at least one upper slit 15 connected with the upper air inlet 4 and at least one lower slit 16 connected with the lower air inlet 5. As FIGS. 3 and 4 also show, in the embodiment shown two upper slits 15 and two lower slits 16 are provided. Each upper slit 15 of the upper level opens tangentially into an upper annular channel 23 and each lower slit 16 of the lower level opens tangentially into a lower annular channel 24. The slits 15, 16 taper with reducing radius in a circumferential direction. The annular channels 23 and 24 taper with reducing radius in an axial direction to an upper slot 25 and a lower slot 26 respectively, and open into a central cylindrical opening 14 to which the fuel jet is also delivered.

The slots 25, 26 are likewise annular in shape. The upper slit 15, the upper annular channel 23 and the upper slot 25 are limited in an upward direction by the annular disk 13. The annular disk 13 has an opening passage 29 which is aligned with the valve opening 3 and is followed in the direction of the flow by the slot 25, the cylindrical opening 14 and the lower slot 26. The cylindrical opening 14 extends axially through the dividing ring 22 as far as into the housing 12. The fuel jet which enters through valve opening 3 into the cylindrical opening 14 aligned with the latter, is seized at the upper swirl level by the swirl flow (air swirl) emanating from the upper slot 25 and at this point there results the impulse exchange between air and fuel. The direction of the air flow through the lower slit 16 at the lower swirl level is opposite to that of the upper swirl level so that at the lower swirl level there results a sense of rotation of the fuel-air swirl opposite to that at the upper swirl level. Due to these opposing directions of rotation of the swirl flows, the rotation of the whole flow downstream from the lower slot 26 is eliminated so that the ejection of the fuel droplets due to centrifugal force from the fuel-air mixture flowing out of the exit opening 28 of the device 11 is avoided.

Because the annular channels 23, 24 taper with reducing radius, the velocity component of the air flow increases in a radial and a tangential direction with the reducing radius of the annular channels 23, 24 and a desired high velocity of the air swirls can thus be achieved.

Figure 5:
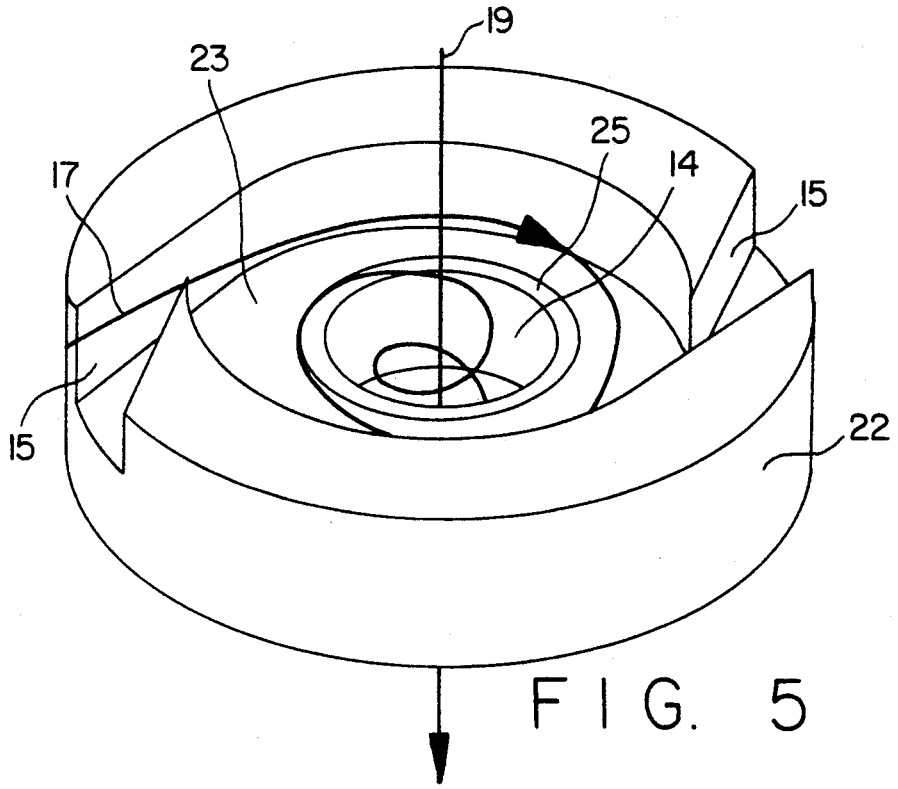
FIGS. 5 and 6 are axonometric representations of the air and liquid flows through the device in accordance with the invention.
Figure 6:
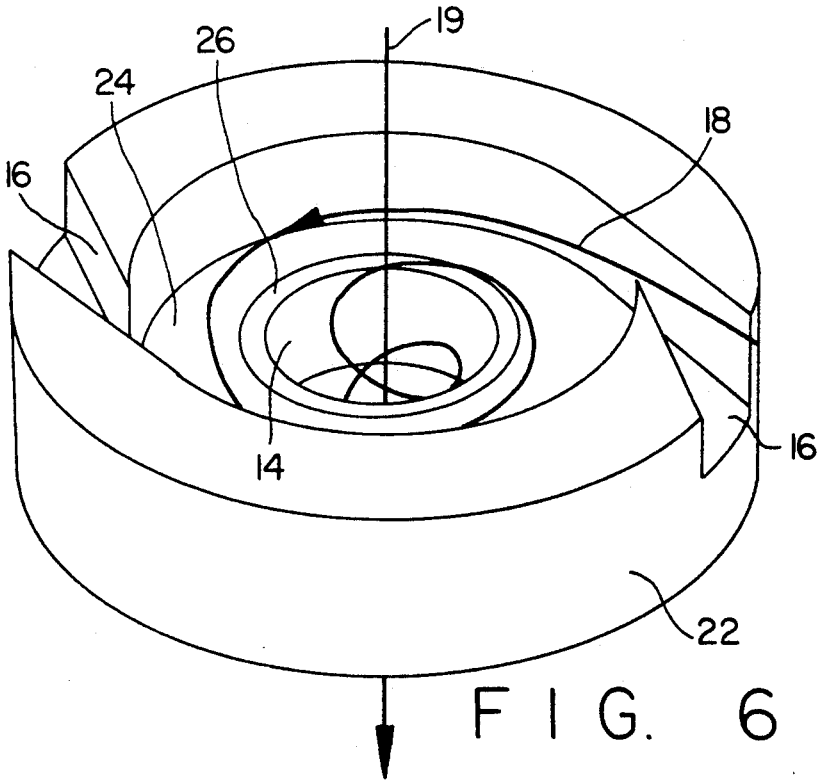

For clarification the upper swirl level is shown in FIG. 5 and the lower swirl level is shown in FIG. 6. It will be seen in FIG. 5 that an air flow 17 is made to enter clockwise through the slit 15 into the annular channel 23, swirls through the upper slot 25 about the fuel jet 19 and then leaves the upper swirl level through the cylindrical opening 14. At the lower swirl level in accordance with FIG. 6, the entry of air takes place through the lower slit 16 and the air flow 18 now swirls about the fuel jet 19 anti-clockwise and leaves the lower swirl level likewise through the cylindrical opening 14. If the swirl flows of the air flows 17 and 18 are of equal magnitude, the rotation of the whole flow downstream of the lower slot 26 is eliminated and a well interspersed fuel-air mixture is delivered to the manifold.

If the ratio of the cross-sectional area of the vertical cylindrical opening 14 to the respective sum of the areas of the slits 15, 16 is chosen to be suitably large, it is ensured that the velocity component in the direction of the longitudinal valve axis remains small. This also ensures that the exit velocity of the fuel droplets from the exit opening 28 is small.

It remains to be pointed out that it is self-evidently also possible to provide exhaust gas recycling and that air flow 17, 18 can be replaced by an exhaust gas flow.

I claim:

1. A device for the atomization of fuel for an internal combustion engine ejected by an injection valve, said device includes a cylindrical passage (14) having a uniform diameter with a fuel inlet opening (29) and a fuel outlet opening (28) coaxial to an axis of the cylindrical passage and upper and lower compressed air swirl passages (17 and 18) situated one above the other axially, each of said upper and lower compressed air swirl passages have a compressed air outlet between said fuel inlet and said fuel outlet openings and in communication with the cylindrical passage and a compressed air inlet, said fuel is ejected through said cylindrical passage from said fuel inlet opening to said fuel outlet opening and said upper and lower swirl passages extend in opposite directions so that a first fluid swirl flow is produced by the upper swirl passages opposite to a second fluid swirl flow produced by the lower swirl passages and the first and second fluid swirl flow passes out through said compressed air outlets to act upon the fuel flow through said cylindrical passage, said upper swirl passage includes at least one upper slit (15) which tapers from an outer larger end to a smaller inner end which opens tangentially into an upper annular channel (23) and said lower swirl passage includes at least one lower slit (16) which tapers from an outer larger end to a smaller inner end which opens into a lower annular channel (24) in such a manner that said second fluid swirl flow (18) is produced in the lower annular channel (24) and swirls in a direction of flow which is in an opposite direction to said first fluid swirl flow (17) produced in the upper annular channel (23).

2. A device for the atomization of fuel for an internal combustion engine ejected by an injection valve, said device includes a cylindrical passage (14) downstream of said injection valve coaxial therewith, an upper annular chamber (23) and a lower annular chamber (24) situated one above the other, at least one upper slit (15) which opens tangentially into said upper annular chamber; said at least one upper slit (15) tapers from a larger outer end to a smaller inner end which connects with said upper annular chamber (23), at least one lower slit (16) which opens tangentially into said lower annular chamber in a direction opposite from that of said at least one upper slit, said at least one lower slit (16) tapers from a larger outer end to a smaller inner end which connects with said lower annular chamber (24), said upper annular chamber (23) includes an annular portion (25) that tapers toward the axis of said cylindrical passage (14) and connects with said cylindrical passage (14), and said lower annular chamber (24) includes an annular portion (26) that tapers toward the axis of said cylindrical passage (14) and connects with said cylindrical passage (14) whereby said at least one upper slit and at least one lower slit (15, 16), said upper and lower annular chambers (23, 24) and said upper and lower tapered annular portions (25, 26) form upper and lower swirl passages in which the swirl in said upper and lower passages are in opposite directions surrounding said cylindrical passage and which act upon a fuel flow through said cylindrical passage (14).

3. A device as set forth in accordance with claim 2, in which the tapered annular portion (25) of said upper swirl passage extends to an upper annular slot that opens into said cylindrical passage (14), and said tapered annular portion (26) of said lower swirl passage extends to a lower annular slot that opens into said cylindrical passage (14).

4. A device for atomization of fuel for an internal combustion engine ejected by an injection valve, said device includes a cylindrical passage (14) downstream of said injection valve coaxial therewith, an upper annular chamber (23) and a lower annular chamber (24) situated one above the other, at least one upper slit (15) which opens tangentially into said upper annular chamber, at least one lower slit (16) which opens tangentially into said lower annular chamber (24) in a direction opposite from that of said at least one upper slit (15), said at least one upper slit tapers from a larger outer end to a smaller inner end which connects with said upper annular chamber 23 said at least one lower slit (16) tapers from a larger outer end to a smaller inner end which connects with said lower annular chamber (24), said upper annular chamber (23) includes an annular portion that tapers toward the axis of said cylindrical passage (14) and connects with said cylindrical passage (14), and said lower annular chamber includes an annular portion that tapers toward the axis of said cylindrical passage (14) and connects with said annular passage (14) whereby said at least one upper and lower slit (15, 16), said upper and lower annular chambers (23, 24), and said upper and lower annular tapered portions of said upper and lower annular chambers form upper and lower swirl passages in which the swirl in said upper and lower swirl passages are in opposite directions surrounding said cylindrical passage and which act upon a fuel flow through said cylindrical passage (14).

5. A device as set forth in accordance with claim 4, in which the annular tapered portion of said upper annular chamber extends to an upper annular slot (25) that opens into said cylindrical passage (14), and said annular tapered portion of said lower annular chamber (24) extends to a lower annular slot (26) that opens into said cylindrical passage (14).

* * * * *